US008550456B2

(12) United States Patent
Hirota et al.

(10) Patent No.: US 8,550,456 B2
(45) Date of Patent: Oct. 8, 2013

(54) IMAGE FORMING APPARATUS

(75) Inventors: Kenichi Hirota, Joso (JP); Hiroshige Inoue, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/545,237

(22) Filed: Jul. 10, 2012

(65) Prior Publication Data

US 2013/0026706 A1 Jan. 31, 2013

(30) Foreign Application Priority Data

Jul. 28, 2011 (JP) ..... 2011-165266

(51) Int. Cl.
*B65H 7/02* (2006.01)

(52) U.S. Cl.
USPC ..... 271/227; 271/228

(58) Field of Classification Search
USPC ..... 271/227, 228
See application file for complete search history.

(56) References Cited

U.S. PATENT DOCUMENTS

| | | | |
|---|---|---|---|
| 5,055,756 | A | 10/1991 | Ohkoda et al. |
| 2002/0017755 | A1 | 2/2002 | Dobberstein et al. |
| 2010/0189486 | A1 | 7/2010 | Inoue |
| 2012/0025457 | A1 | 2/2012 | Inoue |
| 2012/0075681 | A1 | 3/2012 | Inoue |
| 2012/0112405 | A1 | 5/2012 | Hirota |

*Primary Examiner* — David H Bollinger
(74) *Attorney, Agent, or Firm* — Fitzpatrick, Cella, Harper & Scinto

(57) ABSTRACT

A sheet conveying apparatus and an image forming apparatus capable of high-precision sheet position correction includes a data storage portion that stores, at the time of moving a pair of registration rollers in the width direction, the deficiency quantity of a motion quantity in the width direction and an inclination quantity incurred in the pair of registration rollers with respect to the sheet conveying direction. At the time of correcting a skew feeding of a sheet by a pair of skew feeding correction rollers, a controller adjusts a skew feeding quantity detected by an activation sensor by the inclination quantity stored in the data storage portion, and at the time of moving the pair of registration rollers in the width direction, the controller adjusts the motion quantity by the deficiency quantity of the motion quantity stored in the data storage portion.

7 Claims, 12 Drawing Sheets

BEFORE REGISTRATION SHIFT

BEFORE REGISTRATION SHIFT

AFTER REGISTRATION SHIFT

FIG. 6

| | SLIDE DIRECTION OF N-1th | SLIDE DIRECTION OF Nth (SHEET S) | NECESSITY OF CORRECTION OF SLIDE DEFICIENCY QUANTITY Δ |
|---|---|---|---|
| (a) | FAR SIDE → NEAR SIDE DIRECTION | FAR SIDE → NEAR SIDE DIRECTION | YES |
| (b) | | NEAR SIDE → FAR SIDE DIRECTION | NO |
| (c) | NEAR SIDE → FAR SIDE DIRECTION | FAR SIDE → NEAR SIDE DIRECTION | NO |
| (d) | | NEAR SIDE → FAR SIDE DIRECTION | YES |

VIEW IN THE DIRECTION OF ARROW B

Δ(SLIDE DEFICIENCY QUANTITY) = α1 − β1

SLIDE DIRECTION: FAR SIDE → NEAR SIDE

$\alpha 2 = b - a$

SLIDE DIRECTION: NEAR SIDE → FAR SIDE

$\beta 2 = b - a$

IMAGE FORMING APPARATUS

BACKGROUND OF THE INVENTION

1. Field of the Invention

The invention disclosed herein relates to an image forming apparatus, and particularly to a structure for correcting a displacement of a sheet in the width direction perpendicular to the sheet conveying direction.

2. Description of the Related Art

Conventionally, an image forming apparatus such as a copying machine, a printer and a facsimile forms a toner image on an image bearing member such as a photosensitive drum and an intermediate transfer belt, and transfers this toner image onto a sheet conveyed to the transfer portion, during an image formation. Then, the sheet where the toner image has been transferred is conveyed to a fixing portion to fix the image on the sheet. Here, the image forming apparatus has a skew feeding correction portion for correcting skew feeding of the sheet, and displacement of the sheet in a direction (hereinafter referred to as the width direction) perpendicular to the sheet conveying direction, to adjust the posture and the position of the sheet before the sheet is conveyed to the transfer portion.

On the other hand, in recent years, a variety of sheets such as a coated paper, embossed paper, super cardboard and super thin paper has come to be used in an image forming apparatus. Therefore, in an image forming apparatus, it is desired to not only enhance productivity, but also enhance the speed and the precision of skew feeding correction in order to be applicable to all kinds of sheets. Thus in order to enhance the speed and the precision of such skew feeding correction, there has been suggested a skew feeding correction portion of an active skew feeding correction type for correcting the skew feeding during conveying the sheet without stopping the sheet (see U.S. Patent Application Publication No. 2002/0017755 A1).

FIG. 7 illustrates such a conventional configuration of a skew feeding correction portion of an active skew feeding correction type. In this skew feeding correction portion, when activation sensors 27*a* and 27*b* and skew feeding detection sensors 28*a* and 28*b* detect the tip of a sheet, skew feeding correction motors 23 and 24 start driving in accordance with the detection timing. Accordingly, a pair of skew feeding correction rollers 21 and 22 rolls, and conducts skew feeding correction of a sheet S while it conveys the sheet S.

Then, a pair of registration rollers 30 conducts front edge registration and side edge registration. That is, when the front edge of the sheet S is detected by a registration sensor 131, a registration motor 31 is driven and the roll control of the pair of registration rollers 30 is conducted so as to match the image position with the front edge position of the sheet S on a photosensitive drum (not shown). In addition, the registration shift motor 33 is driven based on a detection signal from a lateral registration detection sensor 35, and the pair of registration rollers 30 is laterally moved so as to match the image position with the front edge position of the sheet S on a photosensitive drum. In this manner, the position of the sheet S is precisely corrected with respect to the image on the photosensitive drum, and subsequently the sheet conveyance is repeatedly conducted.

Incidentally, in an image forming apparatus having such a conventional skew feeding correction portion, it is required to slide the pair of registration rollers 30 in either direction of the width in order to correct the lateral registration of the sheet. Therefore, there is one that has a slide drive portion 55 for sliding the pair of registration rollers 30 using a slide drive belt 57 as shown in FIG. 8A.

Here, the pair of registration rollers 30 is rotatably supported by a bearing 53*a* provided in a registration slide unit 56, and is configured to receive a rotational driving force through a driving spindle 51 from the slide drive shaft 50 rotated by a registration drive motor M. In addition, the pair of registration rollers 30 is slidable in the width direction along the slide drive shaft 50 through the slide bearing 53.

In addition, the registration slide unit 56 is configured to receive a slide driving force in the width direction through the slide drive belt 57 from the registration slide motor 54, which is a driving source. When the registration slide unit 56 slides in the width direction while the pair of registration rollers 30 nips the sheet S, the pair of registration rollers 30 slides in the width direction along the slide drive shaft 50 while it nips the sheet S.

However, in such a configuration of the slide drive portion 55, once a driving looseness has occurred, the skew feeding correction precision and/or the lateral registration correction precision of the sheet fluctuate. The driving looseness is a looseness possessed by the slide drive portion 55, and it is due to a flexure difference between the tight side and the slack side of the slide drive belt 57, and a fitting looseness (small gap) between the slide shaft 53 and the slide drive shaft 50 shown in FIG. 11, which is described in the following. Once such a driving looseness occurs, a skew feeding of the sheet occurs, resulting in that the lateral registration correction precision and the skew feeding correction precision further fluctuate.

Next, the difference in slide quantity of the sheet when there is a flexure difference at the tight side/slack side of the slide drive belt 57 is described with reference to FIGS. 9A and 9B. FIG. 9A describes a slide quantity of the sheet in a case that the slide directions of the N−1th and Nth sheets S are different, and FIG. 9B describes a slide quantity of the sheet in a case the slide directions of the N−1th and Nth sheets S are the same.

The case that the slide directions are different is a case that, for example, when the slide direction of the N−1th sheet is from the near side to the far side, the slide direction of the next Nth sheet is from the far side to the near side. In addition, the case the slide directions are the same is a case that, for example, when the slide direction of the N−1th sheet is from the near side to the far side, the slide direction of the next Nth sheet is also from the near side to the far side. In the case that the slide directions are the same, the registration slide unit 56 is once moved back to the near side from the far side, and is moved to the far side from the near side to slide the Nth sheet.

When the slide directions of the N−1th and Nth sheets S are different, the relationship between: difference DS between the side edge position of the sheet detected by the sheet position detection means (not shown) and apparatus center 500; and slide quantity D1 of the slide drive portion 55, is DS=D1 as shown in FIG. 9A.

On the other hand, in the case that the slide directions of the N−1th and N sheets are the same, a drive gear 58 for driving a slide drive belt 57 shown in FIG. 8B is rotated in a direction shown in arrow C to once move back from the far side to the near side to slide the Nth sheet. That is, it is rotated in a direction moving back from the slid position to the home position. Subsequently, the drive gear 58 is rotated in a direction opposite to arrow C. Here, upon rotating in this direction, since the drive gear 58 rotates toward the flexure direction of the slide drive belt 57, it cannot transmit a driving force to the registration slide unit 56 for a moment until the belt flexure side shifts to the tight side.

In this case, as shown in FIG. 9B, slide deficiency quantity Δ of the slide drive portion 55 is generated, and the relationship between DS and slide quantity D2 of the slide drive portion 55 becomes DS=D2−Δ. Accordingly, when the directions of the N−1th and Nth sheets are the same direction, slide deficiency quantity Δ is generated.

Here, as slide deficiency quantity Δ is generated, the positioning displacement quantities of the sheets S from the image forming apparatus center become different between the case that the slide directions of the N−1th and Nth sheets are different and the slide directions of the N−1th and Nth sheets are the same. As a result, a difference arises between: left and right margins α1 of a resulting product when the slide directions of the N−1th and Nth sheets are different (shown in FIG. 10A); and left and right margins β1 of a resulting product when the slide directions of the N−1th and Nth sheets are the same (shown in FIG. 10B). Accordingly, a difference arises in the left and right margins between the case that the slide directions of the N−1th and Nth sheets are different and the case that the slide directions of the sheets are the same, resulting in that an image displacement arises.

Next, a description is made of the effect of a fitting looseness between the slide bearing 53 and the slide drive shaft 50. FIG. 11A illustrates the registration slide unit 56 in a state prior to sliding. At this time, the sheet S is being nipped between the pair of registration rollers 30 after skew feeding correction. In this state, when the registration slide unit 56 slides, a fitting looseness between the slide bearing 53 and the drive shaft 50 incurs an inclination in the registration slide unit 56 in the direction of arrow A as shown FIG. 11B, due to the inertia of the sheet S and the registration slide unit itself. Accordingly, a skew feeding with respect to the skew feeding quantity after the skew feeding correction arises by Δ in the sheet S nipped by the pair of registration rollers 30 along with the registration slide unit 56.

At this time, the arisen skew feeding quantity arises in a direction opposite to arrow A as shown in FIGS. 12A and 12B if the slide direction of the registration slide unit 56 is opposite to the case shown in FIGS. 11A and 11B. Accordingly, when the slide correction directions of the sheets are different, skew feedings of skew feeding quantity α2 and skew feeding quantity β2 in different directions arise.

Thus, the invention disclosed herein has been developed in view of such circumstances, and it is intended to provide a sheet conveying apparatus and an image forming apparatus capable of correcting the position of a sheet with high precision.

SUMMARY OF THE INVENTION

According to the present invention, there is provided an image forming apparatus having an image forming portion and a sheet conveying apparatus which corrects a skew feeding of a sheet and conveys the sheet to the image forming portion, including: a skew feeding detection portion which detects a skew feeding quantity of the sheet; a skew feeding correction portion which corrects the skew feeding of the sheet in accordance with the skew feeding quantity of the sheet detected by the skew feeding detection portion; a side edge detection portion which detects a side edge position of the sheet in a width direction perpendicular to a sheet conveying direction after the skew feeding of the sheet has been corrected by the skew feeding correction portion; a side edge correction portion which moves the sheet in the width direction in accordance with the side edge position of the sheet detected by the side edge detection portion while conveying the sheet, and which corrects the side edge position of the sheet; a data storage portion which stores a deficiency quantity of a motion quantity in the width direction and an inclination quantity incurred in the side edge correction portion with respect to the sheet conveying direction at the time of moving the side edge correction portion in the width direction; and a controller, which, at the time of correcting the skew feeding of the sheet by the skew feeding correction portion, corrects the skew feeding quantity detected by the skew feeding detection portion by the inclination quantity stored in the data storage portion and controls the skew feeding correction portion by the corrected skew feeding quantity, and which, at the time of correcting a position of the side edge correction portion in the width direction, controls the side edge correction portion so as to add a deficiency of the motion quantity stored in the data storage portion and move the sheet in the width direction.

According to the present invention, the positional correction of a sheet with high precision is achieved by adjusting a skew feeding quantity detected by the skew feeding detection portion to correct skew feeding of the sheet, and by adjusting a motion quantity to move the side edge correction portion in the width direction.

Further features of the present invention will become apparent from the following description of exemplary embodiments with reference to the attached drawings.

BRIEF DESCRIPTION OF THE DRAWINGS

FIG. 6 is a chart showing an addition of a slide deficiency quantity in accordance with the pattern of slide directions of a sheet in the second embodiment of the present invention;

DESCRIPTION OF THE EMBODIMENTS

Figure 1:
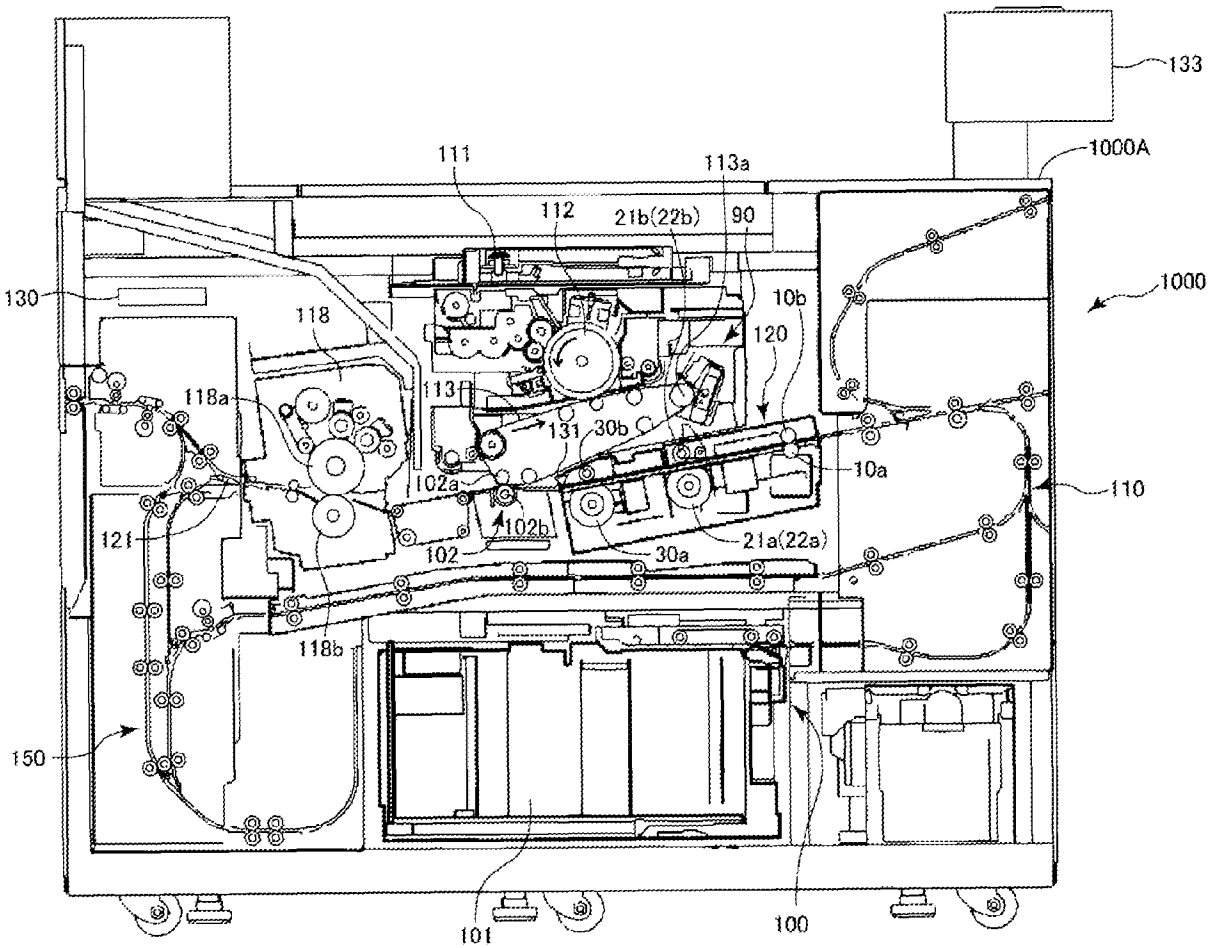
FIG. 1 is a schematic view illustrating a color image forming apparatus as an example of an image forming apparatus having a sheet conveying apparatus according to the first embodiment of the present invention.

In the following, embodiments of the present invention will be described in detail with reference to the drawings. FIG. 1 is a schematic view illustrating a color image forming apparatus as an example of an image forming apparatus having a sheet conveying apparatus according to the first embodiment of the present invention. FIG. 1 illustrates a color image forming apparatus 1000 and a color image forming apparatus body 1000A (hereinafter referred to as the device body). The device body 1000A includes: an image forming portion 90; a sheet feeding portion 100 for conveying a sheet; and a transfer portion 102 for transferring a toner image formed by the image forming portion 90 onto the sheet fed by the sheet feeding portion 100.

FIG. 1 illustrates a sheet conveying apparatus 110 for conveying the sheet fed by the sheet feeding portion 100 to the transfer portion 102. This sheet conveying apparatus 110 includes a registration unit 120, which is a skew feeding correction device for conducting a skew feeding correction and/or timing correction of a sheet. In addition, FIG. 1 illustrates a controller 130 for controlling the image forming operation of the color image forming apparatus 1000, and illustrates an operation portion 133.

Here, the image forming portion 90 includes: a photosensitive drum 112 for sequentially forming toner images of yellow (Y), magenta (M), cyan (C) and black (Bk); and a laser scanner 111 and the like for exposing the electrically-charged photosensitive drum 112 to form an electrostatic latent image. In addition, it includes an intermediate transfer belt 113, on which toner images of four colors formed on the photosensitive drum 112 are transferred in a sequentially superimposed manner. This intermediate transfer belt 113 is suspended in a tensioned condition by a driving roller 113*a*, a transfer inner roller 102*a* and the like, and is rotationally driven in the arrow direction with the same circumferential velocity as the photosensitive drum 112. In addition, the transfer portion 102 includes the transfer inner roller 102*a* and the transfer outer roller 102*b*, which are substantially opposed to each other through the intermediate transfer belt 113, and transfers an unfixed image onto the sheet by providing an electrostatic load bias to the transfer outer roller 102*b*.

In the color image forming apparatus 1000 of such a configuration, in order to form an image, firstly, a laser scanner 111 projects, based on the image information, a laser beam onto the photosensitive drum 112, of which the surface is uniformly electrically charged. In this manner, for example, a yellow latent image is formed on the surface of the photosensitive drum. Then, by developing the electrostatic latent image formed on the photosensitive drum 112 using yellow toner, a yellow toner image is formed on the photosensitive drum 112, and subsequently, this yellow toner image is transferred onto the intermediate transfer belt 113. Then, similarly, magenta, cyan and black toner images are subsequently formed, and each toner image is transferred onto the intermediate transfer belt 113. As a result, a full-color toner image is ultimately formed on the intermediate transfer belt 113.

In addition, in parallel with such a toner image forming operation, a sheet stored in a sheet feeding cassette 101 is fed out by a sheet feeding portion 100, and subsequently, the sheet S is conveyed to the registration unit 120. After the skew feeding correction and/or timing correction are conducted in this registration unit 120, it is conveyed to the transfer portion 102. After this, a full-color toner image is transferred onto the sheet S by applying a predetermined pressure and an electrostatic load bias in the transfer portion 102.

Next, the sheet S, on which the toner image is transferred in that manner, is conveyed to a fixing device 118 having a fixing roller 118*a* and a pressure roller 118*b*. Then, when it passes a fixing nip portion defined by the fixing roller 118*a* and the pressure roller 118*b*, the sheet is heated and pressurized, and thus the toner image is fixed on the sheet. After the toner image is fixed in this manner, the sheet S is discharged from the device body 1000A.

After that, if images are formed on both sides of the sheet S, it is conveyed to the reverse conveying apparatus 150 by switching a paper discharge switch member 121. Then, when it is conveyed to the reverse conveying apparatus 150 in this manner, the front and rear edges of the sheet are switched by a switchback operation, and the sheet is sent to the transfer portion 102. After that, the image forming process to form images on the second side of the sheet is the same as the first side, and thus is not repeated.

Figure 2:
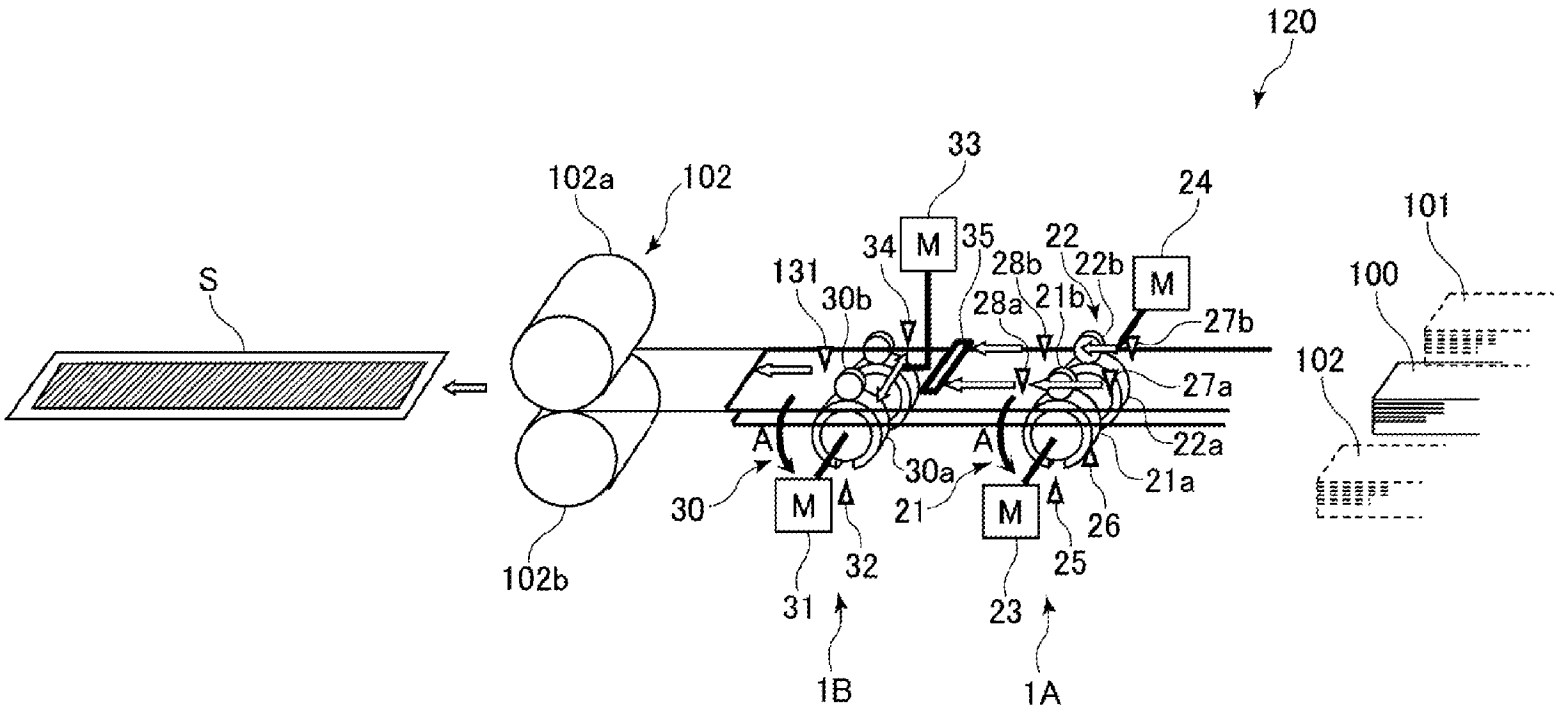
FIG. 2 illustrates a configuration of a registration unit provided in the sheet conveying apparatus.

As shown in FIG. 2, the registration unit 120 includes: a skew feeding correction roller portion 1A, which is a skew feeding correction portion for correcting the skew feeding of the sheet; a lateral registration correct portion 1B for correcting a crosswide displacement of the sheet. Here, the skew feeding correction roller portion 1A has a pair of skew feeding rollers 21 and 22 provided with a predetermined space in between in the width direction.

This pair of skew feeding rollers 21 and 22 include: driving rollers 21*a* and 22*a*, which are driving rotating members each having a notch on the circumference; and follower rollers 21*b* and 22*b*, which are follower rotating members pressed against the driving rollers 21*a* and 22*a* by a compression spring (not shown). The driving rollers 21*a* and 22*a* are connected to skew feeding correction motor 23 and 24.

In addition, in the upstream of the pair of skew feeding correction rollers 21 and 22 in the sheet conveying direction, activation sensors 27*a* and 27*b* are provided, which are first skew feeding detection sensors having a predetermined space between them in the width direction. Here, these activation sensors 27*a* and 27*b* are for detecting a skew feeding quantity of a sheet, and start driving the skew feeding correction motors 23 and 24 in accordance with timing, at which the activation sensors 27*a* and 27*b* detect the front edge of the sheet. Then, by driving the skew feeding correction motors 23 and 24 in accordance with timing, at which the activation sensors 27*a* and 27*b* detect the front edge of the sheet, the skew feeding of the sheet is corrected.

In addition, in the downstream of the pair of skew feeding correct rollers 21 and 22 in the sheet conveying direction, skew feeding detection sensors 28*a* and 28*b* are arranged at a predetermined interval in the width direction. The skew feeding detection sensors 28*a* and 28*b* are second skew feeding detection sensors for detecting whether a skew feeding has been completely corrected by the pair of skew feeding correction rollers 21 and 22. When a skew feeding of the sheet S is detected by the skew feeding detection sensors 28*a* and 28*b*, a skew feeding correction is again conducted by the pair of skew feeding correction rollers 21 and 22. In this embodiment, the skew feeding of a sheet is corrected by preceding-side speed reduction control for reducing the speed of the preceding-side of the sheet front edge.

In addition, a lateral registration correction portion 1B has a pair of registration rollers 30. This pair of registration rollers 30 includes: a registration driving roller 30*a*, which is a driving rotating member having a notch on the periphery; and a registration follower rotating member 30*b*, which is a follower rotating member pressed to the registration driving roller 30*a* by a pressure spring (not shown). This registration driving roller 30*a* is connected to a registration motor 31.

Figure 8A:
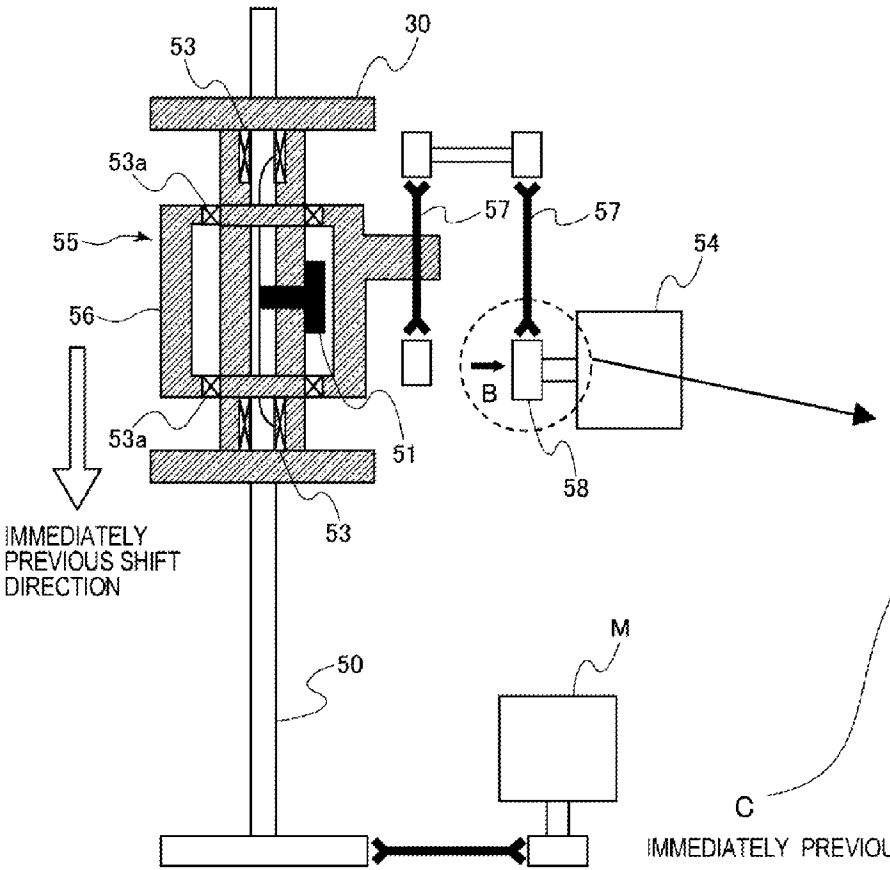
FIGS. 8A and 8B illustrate a configuration of driving the pair of registration rollers of the aforementioned skew feeding correction potion.
Figure 8B:
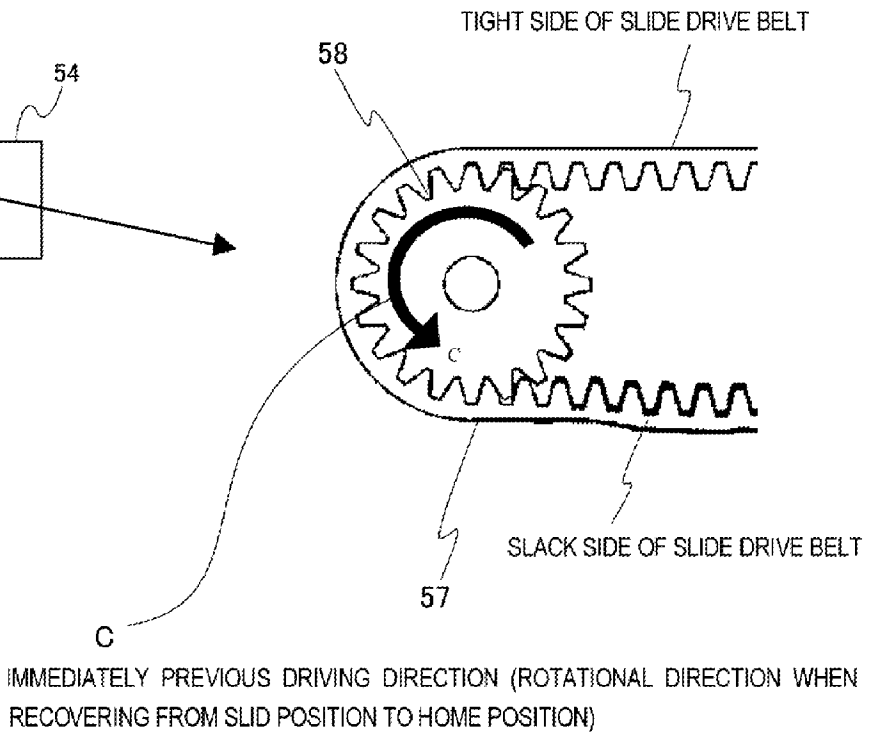
Figures 9A, 9B:
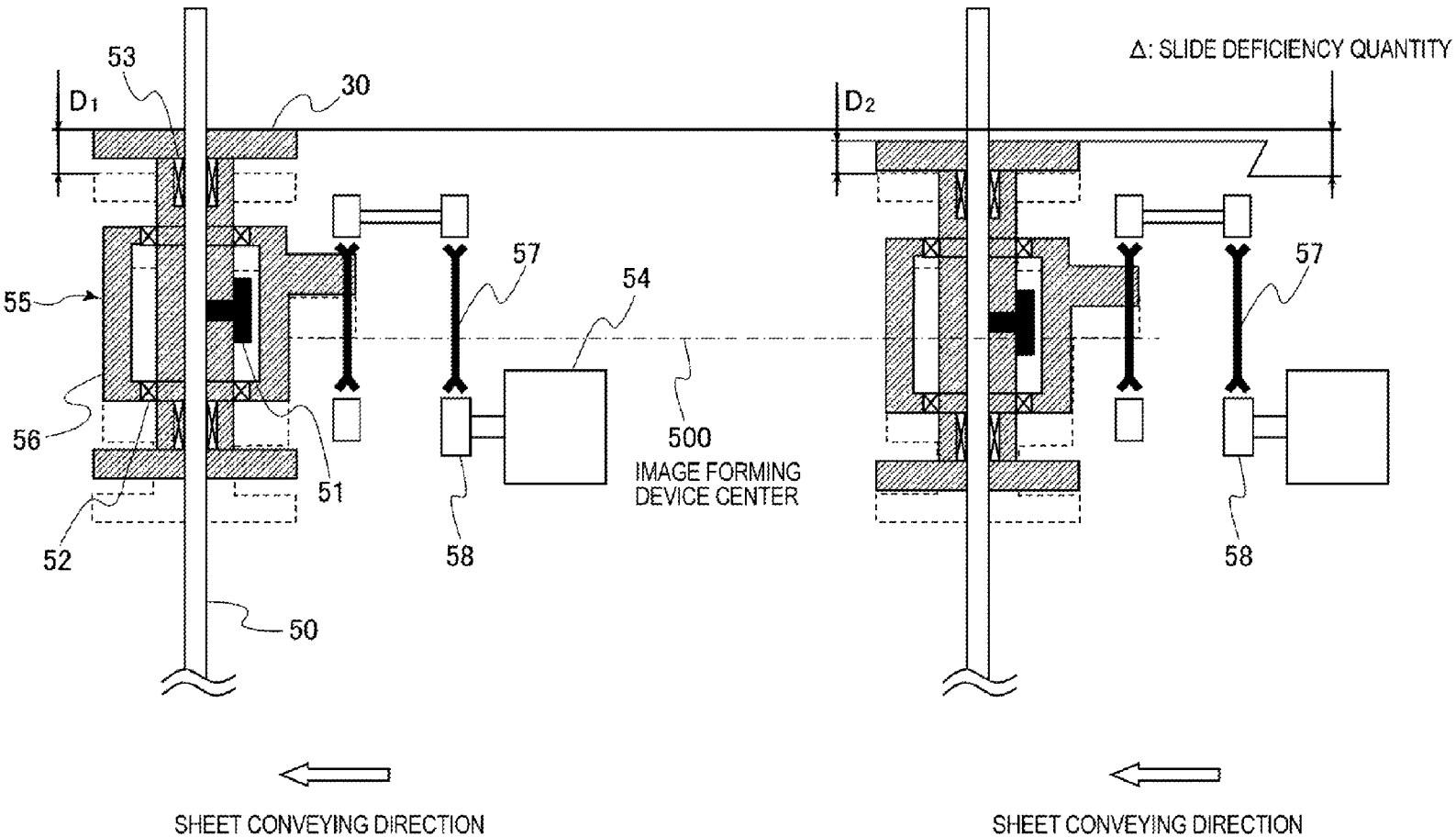
FIGS. 9A and 9B describe the difference in slide quantity of a sheet when there is a flexure difference at the tight side/slack side of the slide drive belt for sliding the pair of registration rollers.
Figure 10A:
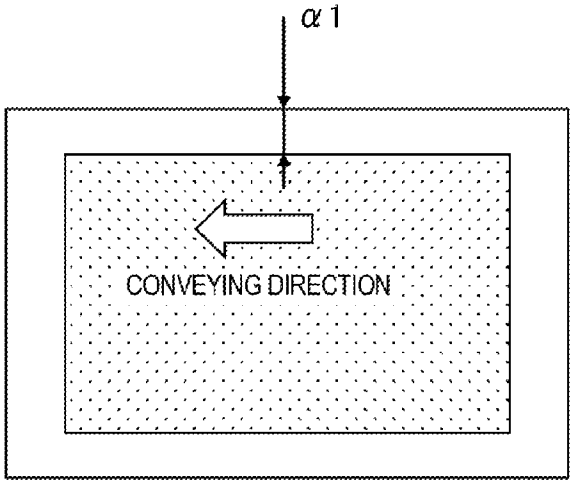
FIGS. 10A and 10B describe a resulting product when there is a difference in the slide quantity of the sheet.
Figure 10B:
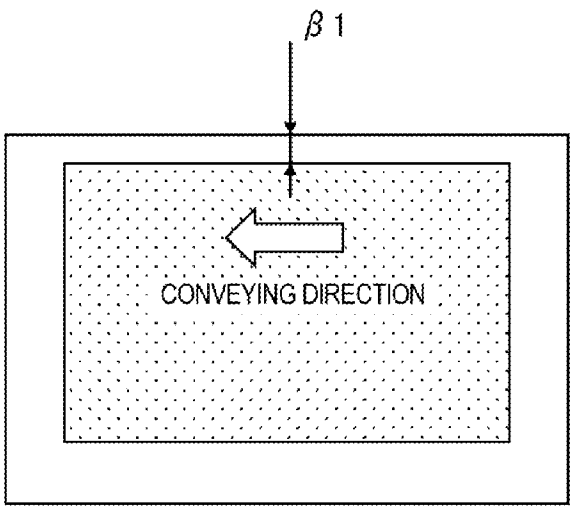

Here, the pair of registration rollers 30, which constitutes a shift roller, is provided slidably in the width direction perpendicular to the sheet conveying direction, and the registration driving roller 30*a* (the pair of registration rollers 30) is driven in the width direction by a registration shift motor 33, which is a shift driving portion. In this embodiment, the registration shift motor 33 is adapted to slide the pair of registration rollers 30 using the aforementioned slide drive belt 57 shown in FIGS. 8A and 8B.

In addition, in the upstream of the pair of registration rollers 30 in the sheet conveying direction, a lateral registration detection sensor 35 is installed. This lateral registration detection sensor 35 constitutes a side edge detection portion for detecting a lateral registration position, which is a position in the width direction of a conveyed sheet. The registration shift motor 33 is driven in accordance with a lateral registration position (side edge position) detected by the lateral registration detection sensor 35 to slide the pair of registration rollers 30 in an axial direction, and thus the side edge position of the sheet is corrected. That is, in this embodiment, the pair of registration rollers 30, which is a side edge correction portion, conveys the sheet and simultaneously moves the sheet in the width direction in accordance with the side edge position detected by the lateral registration detection sensor 35, to correct the side edge position of the sheet.

Furthermore, a registration sensor 131 for detecting the front edge of the sheet S is provided in the downstream of the pair of registration rollers 30. FIG. 2 illustrates: skew feeding correction HP sensors 25 and 26 for detecting the HP (home position) of the pair of skew feeding correction rollers 21 and 22; a registration HP sensor 32 for detecting the pair of registration rollers 30; and a registration shift HP sensor 34.

Figure 3:
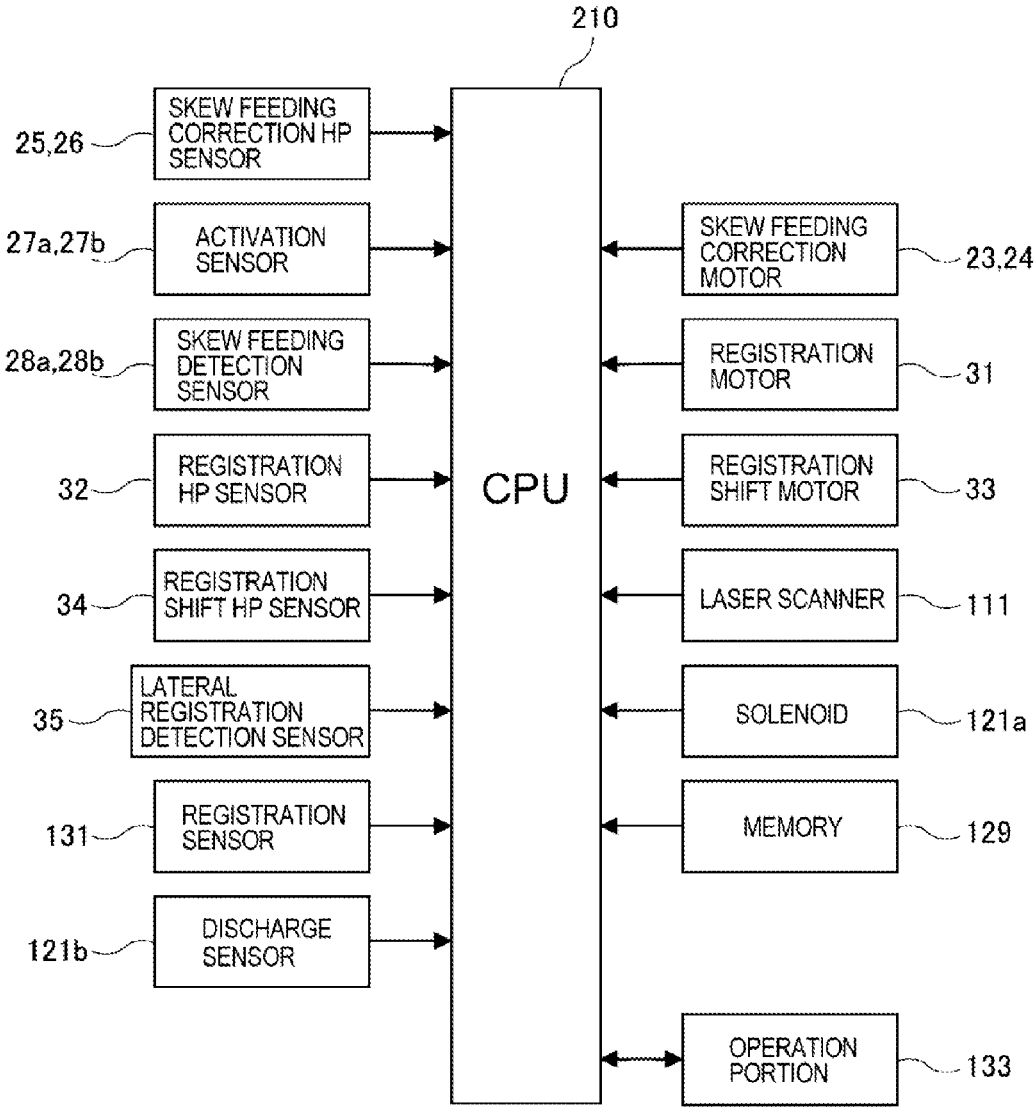
FIG. 3 is a control block diagram of the color image forming apparatus.

FIG. 3 is a control block diagram of the color image forming apparatus 1000. Detection signals from the aforementioned skew feeding correction HP sensors 25 and 26 and the activation sensors 27*a* and 27*b* are input into a CPU 210, which is a controller installed in a controller 130 (see FIG. 1). In addition, detection signals from the skew feeding detection sensors 28*a* and 28*b*, the registration HP sensor 32, the registration shift HP sensor 34, the lateral registration detection sensor 35, the registration sensor 131, and the discharge sensor 121*b* are input into the CPU 210 of this controller.

On the other hand, the CPU 210 is connected to the skew feeding correction motors 23 and 24, the registration motor 31, the registration shift motor 33, the laser scanner 111, a memory 129 (data storage portion), an operation portion 133, and a solenoid 121*a*. The CPU 210 is adapted to drive each motor and the like based on a detection signal from each sensor and a copy or print start signal from the operation portion 133.

In this embodiment, for example at the time of manufacturing a device body, an image formation is conducted in a manner that a sheet is positioned at the near side, which is one side of the sheet in the width direction shown by 102 in FIG. 2, and at the center of the sheet in the width direction shown by 100 in FIG. 2, and at the far side, which is the other side of the sheet in the width direction shown by 101 in FIG. 2. Thus, one can obtain a sample of a slide deficiency quantity in the aforementioned case that the slide directions (motion direction) shown in FIG. 12B are different due to the tight side and slack side of the slide drive belt 57.

Figure 12A:
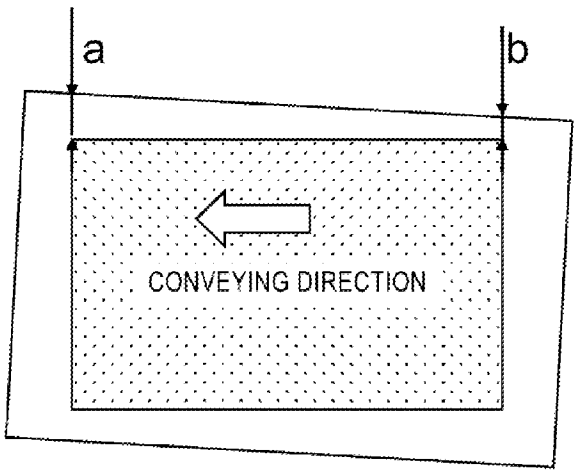
FIGS. 12A and 12B describe a resulting product when there is a fitting looseness.
Figure 12B:
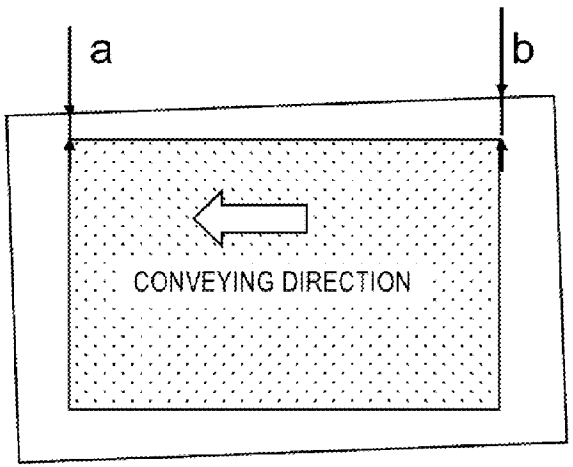

In addition, one can obtain samples of skew feeding quantities $\alpha 2$ and $\beta 2$ in the aforementioned cases that the slide direction shown in FIG. 12A is from the far side to the near side and the slide direction shown in FIG. 12B is from the near side to the far side due to fitting looseness between the slide bearing 53 and the slide drive shaft 50. The memory 129 stores the slide deficiency quantity obtained in this manner in the case that the slide directions are different is stored in, and also the skew feeding quantity of the sheet in accordance with the amount of inclination with respect to the sheet conveying direction, which is incurred in the pair of registration rollers 30 due to fitting looseness when the pair of registration rollers 30 are moved in the width direction.

Prior to the skew feeding correction, the CPU 210 adds a skew feeding offset quantity in accordance with the skew feeding quantity $\beta 2$ shown in FIG. 12B at the time of the skew feeding correction operation in the case that the sheet correction direction is from the near side to the far side, based on a signal from the lateral registration detection sensor 35. In addition, when the sheet correction direction is from the far side to the near side, it adds a skew feeding offset quantity in accordance with the skew feeding quantity $\alpha 2$ shown in FIG. 12 at the time of the skew feeding correction operation.

That is, the CPU 210, which is a controller, corrects the skew feeding of a sheet by a skew feeding quantity where the skew feeding quantity detected by the skew feeding sensors 28*a* and 28*b* has been corrected by a skew feeding offset quantity stored in the memory 129. In this manner, during the operation for correcting the skew feeding of a sheet with reference to the side edge along with the sheet carrying direction of the sheet, the skew feeding of the sheet is corrected with reference to the side edge by a skew feeding quantity corrected by the skew feeding offset quantity. In this manner, even if there is a fitting looseness between the slide bearing 53 and the slide drive shaft 50, the image position is consistently maintained by correcting the skew feeding of a sheet by a skew feeding quantity corrected by a skew feeding offset quantity.

In addition, in the case that the slide directions are the same, after the skew feeding is corrected, the CPU 210 corrects a lateral registration quantity (sheet side edge positional information) detected by the lateral detection sensor 35, by the lateral registration offset quantity in accordance with the slide deficiency quantity $\Delta$ stored in the memory 129. Thus, even if there is a flexure difference in the slide drive belt 57, the image position is consistently maintained by correcting the motion quantity in the width direction of a sheet by the lateral registration offset quantity.

In this manner, in this embodiment, the skew feeding correction motors 23 and 24 decrease or increase a rotation quantity in accordance with the predetermined skew feeding offset with reference to the position of the front edge of a sheet detected by the sensors 27 and 28 at the time of rotating the sheet. That is, the CPU 210 determines (adjusts) the skew feeding correction quantity based on the skew feeding offset quantity, and operates the skew feeding correction motors 23 and 24. In addition, when the slide directions are the same, the lateral registration detection sensor 35 corrects the lateral registration quantity detected by the lateral registration detection sensor 35 by the registration offset quantity, to drive the registration shift motor 33.

Next, a description will be made of the skew feeding correction and registration correction control operations of the color image forming apparatus 1000 according to this embodiment with reference to the flow chart shown in FIG. 4. In the case of the color image forming apparatus 1000, the surface of the fixing roller 118*a* of the aforementioned fixing device 118 shown in FIG. 1, to which a sheet is conveyed after a toner image has been transferred, is formed by a rubber portion so as to match a sheet such as an embossed paper, and is soft. Therefore, particularly, when sheets having a high stiffness with burrs larger than ever are continuously fed onto the same region of the fixing roller 118*a* for a long time, the rubber portion constituting the surface layer of the fixing roller 118*a* is damaged, resulting in that its life is extremely shortened.

Therefore, in this embodiment, when a sheet is conveyed, simultaneously an image formed on the photosensitive drum is displaced by a predetermined quantity, and also the sheet correction position in the width direction by the pair of registration rollers is displaced. In this manner, it can prevent a sheet form being conveyed onto the same region of the fixing roller and prevent the surface layer of the roller from being damaged. Hereinafter, the sheet correction position in the width direction by the pair of registration rollers 30 displaced by a predetermined quantity is referred to as a reciprocal position.

Once copying or printing starts, the CPU 210 determines the reciprocal position of the first surface by the device body 1000A in accordance with the duplex mode/single sided mode set by the operation portion 133 (Step 1). After the reciprocal/exposure position determination process, a laser exposure starts in accordance with the determined reciprocal position after a predetermined time (Step 2).

Then, after the reciprocal/exposure position determination process, when the activation sensors 27*a* and 27*b* detect the front edge of the sheet S conveyed into the registration unit 120, the skew feeding correction motors 23 and 24 are activated with reference to the detection timing of each of the activation sensors 27*a* and 27*b*. By the detection time difference of the activation sensors 27*a* and 27*b*, the skew feeding quantity of the sheet front edge is calculated, and the correction quantity is computed. Based on the computed correction quantity, the aforementioned preceding-side speed-reduction control rotates the pair of skew feeding rollers 21 and 22 where a roller nip portion has been released, and conducts the first skew feeding correction (Step 3).

Then, after the completion of the skew feeding correction roller activation control and the first skew feeding correction, the sheet position is sampled at the lateral registration detection sensor 35 (Step 4). Then, the correction direction during the sheet correction at the next step is determined from the sampled edge position of the sheet S (Step 5). That is, it is determined whether the sheet S is slid toward the near side or far side in the width direction.

Then, after the sheet correction direction check (pre-sampling) process, it waits for the skew feeding detection sensors 28*a* and 28*b* to be ON (Step 6). Then, the skew feeding detection sensors 28*a* and 28*b* become ON (Y of Step 6), the skew feeding quantity of the sheet front edge is calculated with reference to each of detection timing and sheet correction direction, and the correction quantity is computed. Subsequently, based on the computed correction quantity, the skew feeding correction motors 23 and 24 are driven by the aforementioned preceding-side speed-reduction control, and the second skew feeding correction is conducted (Step 7).

Figure 5A:
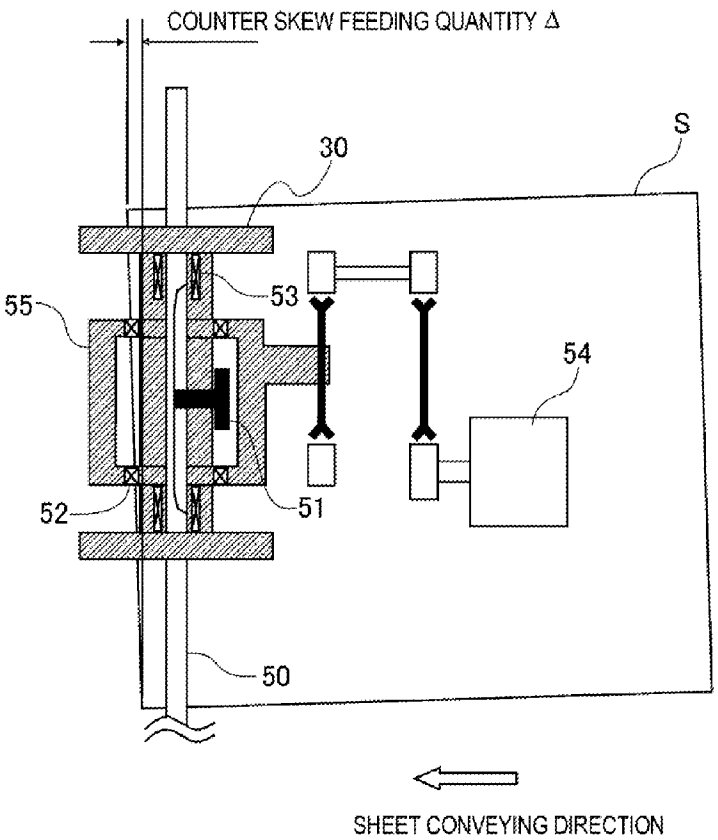
FIGS. 5A and 5B illustrate the operation of solving an inclination due to fitting looseness by the lateral registration correction portion provided in the sheet conveying device.
Figure 5B:
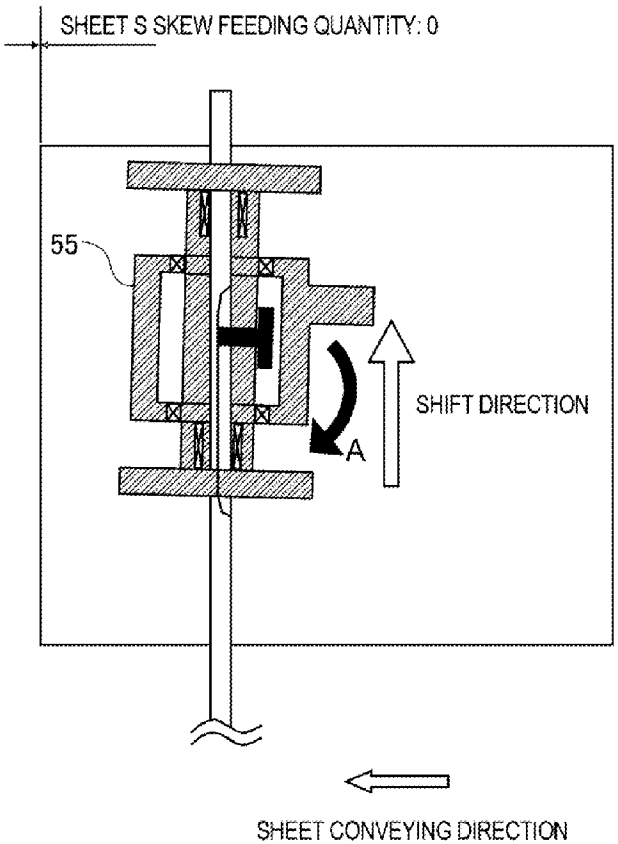
Figure 7:
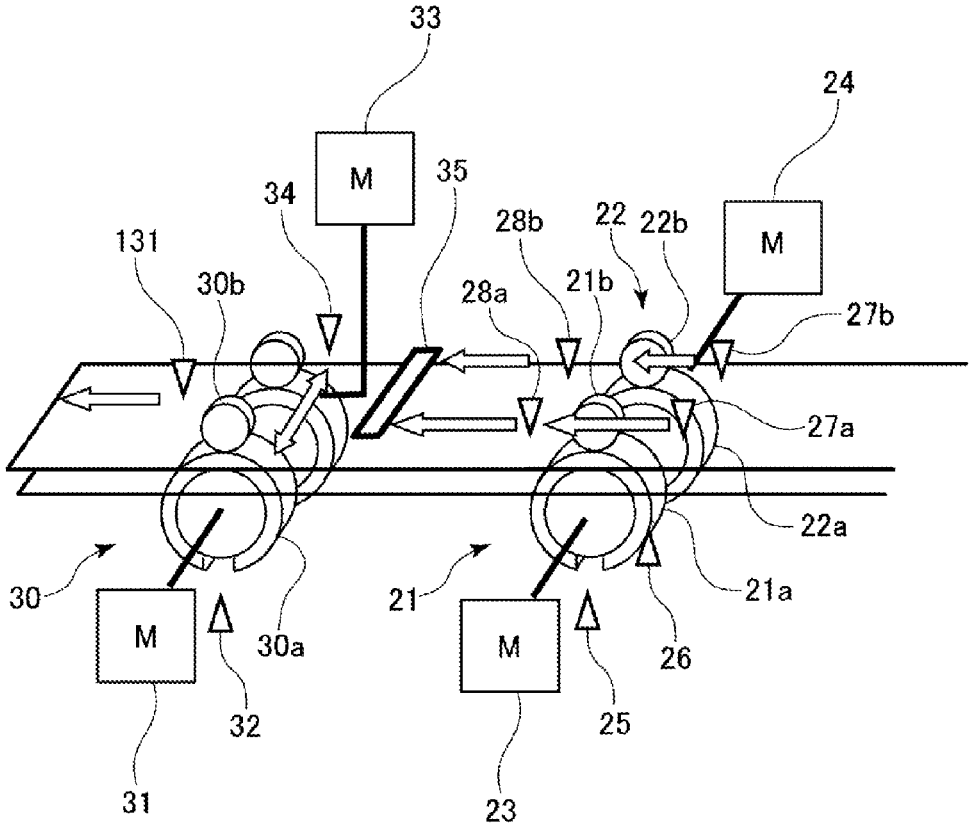
FIG. 7 PRIOR ART
FIG. 7 illustrates a configuration of a skew feeding correction portion of a conventional active skew feeding correction type.
Figure 11B:
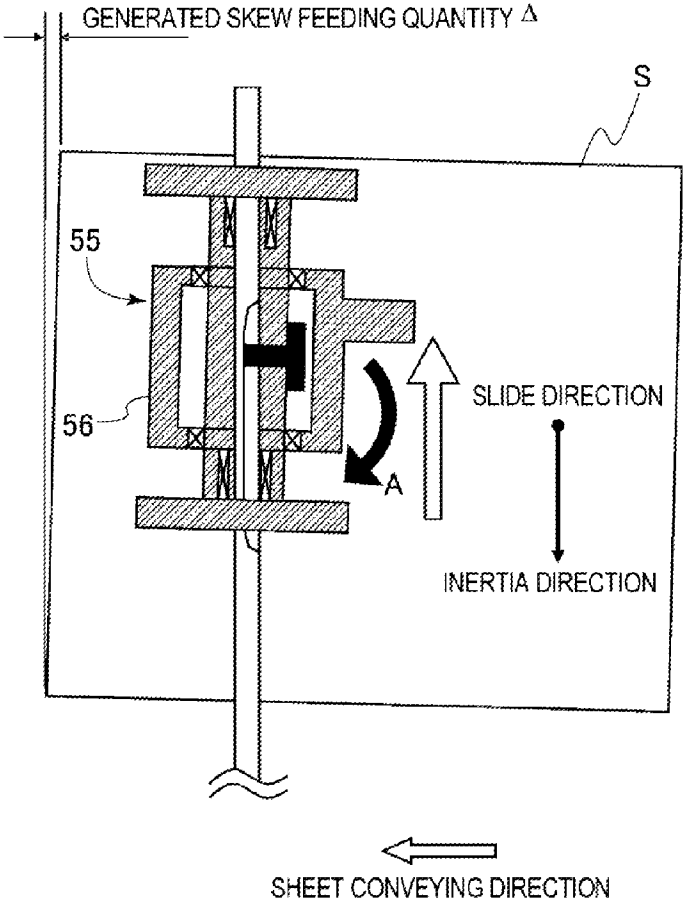
FIGS. 11A and 11B describe an effect of a fitting looseness of a slide bearing and the slide drive shaft of the skew feeding correct portion.
Figure 11A:
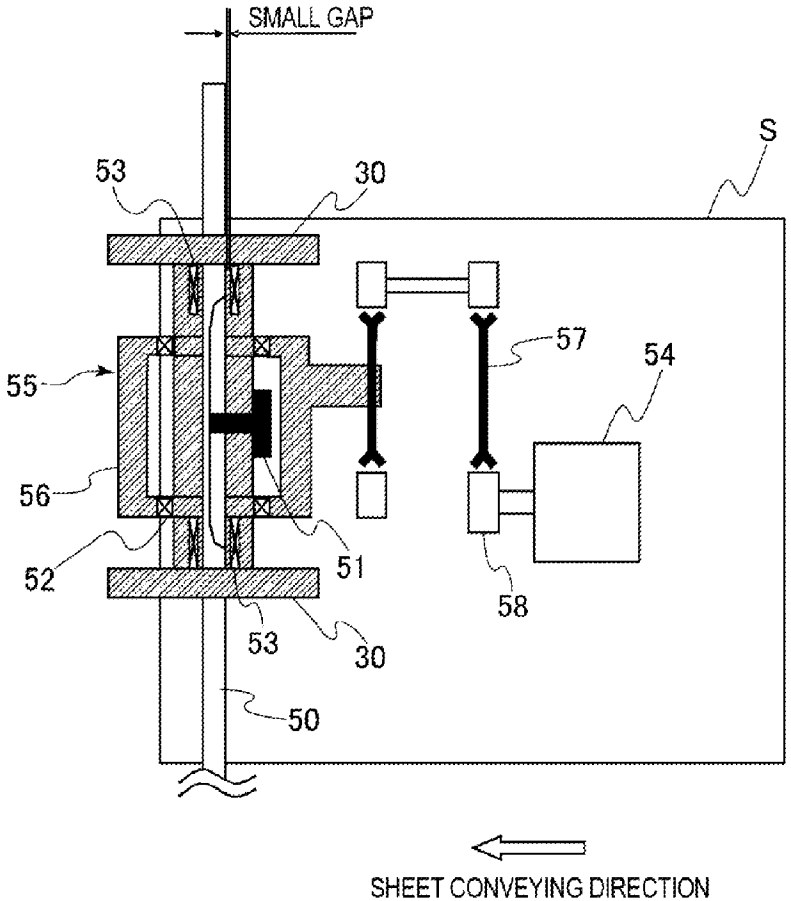

Here, during the second skew feeding correction control, the second skew feeding offset quantity is added in accordance with the correction direction during the sheet correction. For example, when the sheet correction direction is from the near side to the far side, the skew feeding offset quantity corresponding to the skew feeding quantity $\beta 2$ is added. Thus, the inclination (counter skew feeding quantity $\Delta$) as shown in FIG. 5A due to the aforementioned fitting looseness as shown in FIG. 11A is solved as shown in FIG. 5B. In a case that the sheet correction direction is from the far side to the near side, the skew feeding offset quantity corresponding to the skew feeding quantity $\alpha 2$ is added. In this manner, the inclination due to the fitting looseness is made 0.

Then, after the second skew feeding correction control, the registration motor 31 is activated with reference to the skew feeding detection sensor (the behind side of the skew feeding detection sensor) (Step 8: registration roller activation control). In this manner, the pair of registration rollers 30 where the roller nip portion has been released, rotates and conveys the sheet S. Subsequently, once the sheet S is nipped by the pair of registration rollers 30, each of the skew feeding correction motors 23 and 24 is stopped with reference to the skew feeding correction HP sensor in a state that the roller nip portion of the pair of skew feeding correction rollers 21 and 22 is released (Step 9: skew feeding correction roller HP stop control).

Subsequently, it waits for the registration sensor 131 to detect a sheet and become ON (Step 10). Then, once the registration sensor 131 detects the sheet and becomes ON (Y of Step 10), the lateral registration detection sensor 35 detects the side edge position of the sheet S (Step 11). Subsequently, after the preceding registration lateral registration detection process, the speed of the registration motor 31 is operated by a signal from the registration sensor 131 (Step 12).

In addition, the registration shift motor 33 is activated, and simultaneously the motion quantity is computed by correcting the lateral registration quantity detected by the lateral registration detection sensor 35, by the lateral registration offset quantity in accordance with the slide deficiency quantity $\Delta$ stored in the memory (Step 13). In this manner, even if there is a flexure difference in the slide drive belt 57, the sheet is moved to the predetermined lateral registration position by the pair of registration rollers 30.

Then, based on the time difference between the detection timing of the registration sensor 131 and the timing of projecting a laser beam on the photosensitive drum 112, the speed control of the registration motor 31 is conducted, and the image position on the photosensitive drum and the front edge position of the sheet S are matched. In addition, based on the detection signal of the lateral detection sensor 35 and the determined reciprocal position, the registration shift motor 33 is controlled, and the image position on the photosensitive drum 112 and the lateral registration position of the sheet S are matched (Step 14).

Then, after the preceding registration lateral registration correction control, once the pair of registration rollers 30 conveys the sheet S to the transfer portion, the registration motor 31 is stopped with reference to the registration HP sensor 32 in a state that the roller nip portion of the pair of registration rollers 39 is released (Step 15). Simultaneously, the registration shift motor 33 is activated and shifted in a direction opposite to the correction direction, and after the registration shift HP sensor 34 becomes OFF, the registration shift motor 33 is stopped (Step 16).

Then, the image on the photosensitive drum 112 and the sheet S, which has undergone the position correction with a high precision, are conveyed to the fixing device 118, and then this embodiment determines whether the discharge sensor 132 becomes ON in the case of the duplex modes (Step 17). Then, once the discharge sensor 132 becomes ON (Y of Step 17), this embodiment activates a solenoid 121*a* based on this, and switches the paper discharging switching member 121, and conveys the sheet to a reverse path 123 (Step 18). In the case of single sided mode, the sheet is discharged to the sheet processing apparatus 500 by the conveying roller 119 and the discharge roller 122.

As described above, in this embodiment, a skew feeding offset quantity is added in accordance with the correction direction during the sheet correction at the time of the second skew feeding correction. In addition, during the lateral registration correction, when the slide directions are the same, a lateral registration offset quantity is added. That is, at the time of correcting the skew feeding of a sheet, it adjusts the skew feeding quantity detected by the activation sensors 27*a* and 27, and at the time of moving the pair of registration rollers 30, it adds a slide deficiency quantity to adjust the motion quantity, and thus the correction of the sheet position is conducted with high precision. In this manner, the skew feeding of the sheet S incurred by a mechanical looseness is prevented, and simultaneously, the skew feeding quantity of a resulting product is kept constant without depending on the slide direction of the pair of registration rollers 30, which resulting in that the image forming apparatus capable of a high precision sheet position correction operation is provided.

Next, the second embodiment of the present invention will be described. In this embodiment, after the sheet position correction direction is determined in Step 5 of the aforementioned flowchart shown in FIG. 4, the deficiency quantity of a slide quantity is added in accordance with the pattern of the slide directions of the N−1th sheet and the Nth sheet. In this manner, the slide deficiency of the sheet due to a driving looseness is prevented.

FIG. 6 shows an addition of a slide deficiency quantity in accordance with the pattern of the slide direction of the sheet S in this embodiment. When the sheet correction directions of the N−1th and the Nth are the same direction as shown in item (a) of FIG. 6, the registration slide motor 54 is preliminarily driven in the determined slide direction by the slide deficiency quantity after Step 5 of the aforementioned flow chart shown in FIG. 4. Thus, the pair of registration rollers 30 moves in the width direction by the deficiency quantity of the motion quantity in advance. By moving the pair of registration rollers 30 in the width direction by the deficiency quantity of the motion quantity in advance (namely, a looseness pulling operation within a registration slide configuration), the pair of registration rollers 30 then moves in the width direction from this position.

Figure 4:
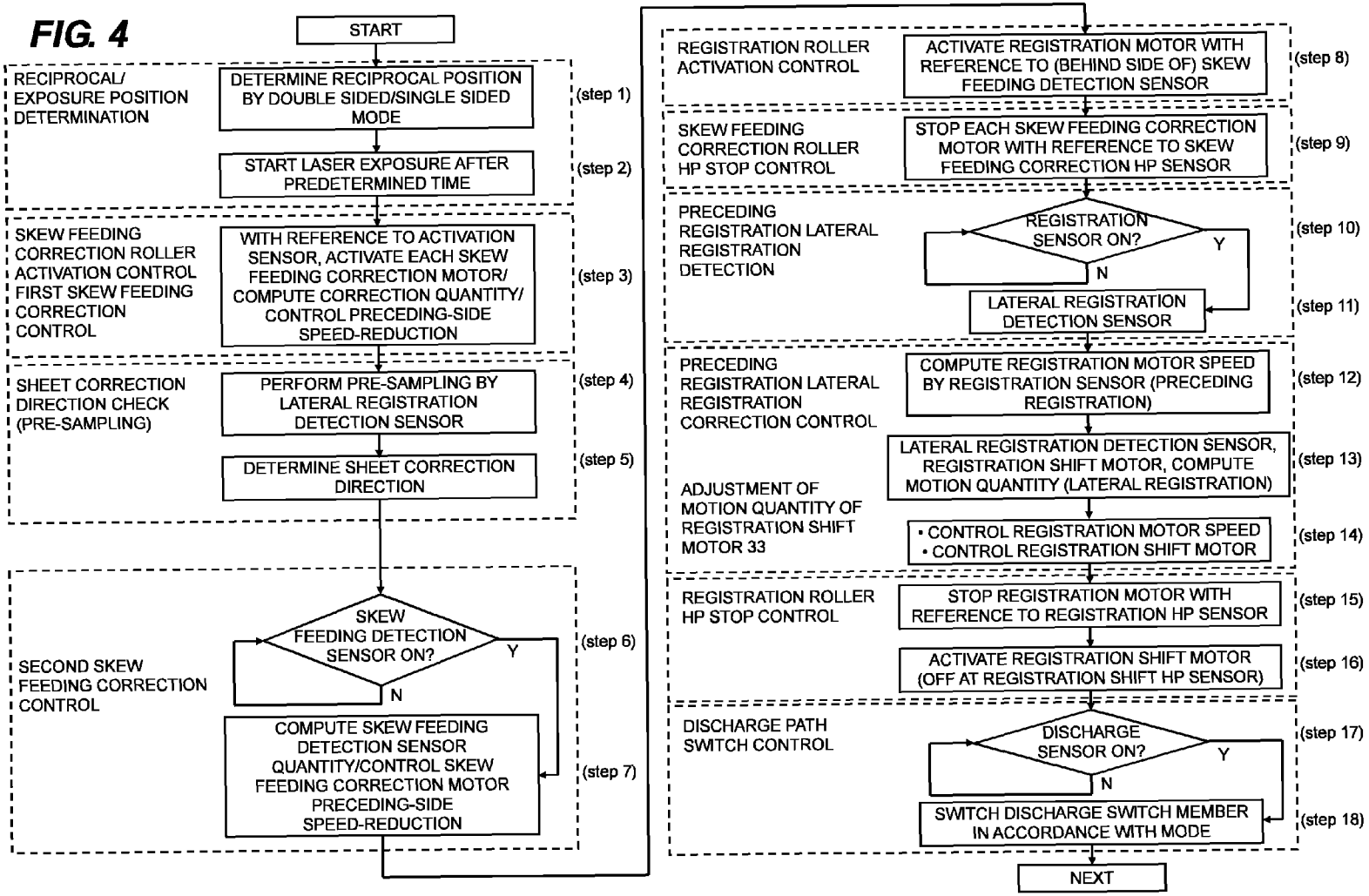
FIG. 4 is a flowchart of control operations of skew feeding and registration correction of the color image forming apparatus.

In addition, in the case that the sheet correction directions of the N−1th and the Nth are the same direction (from the near side to the far side) as shown in item (d) of FIG. 6, the registration slide motor 54 is preliminarily driven to the slide direction determined in Step 5 immediately after Step 5 of the aforementioned flowchart shown in FIG. 4. Subsequently, a slide operation is conducted using motion quantity DS computed in Step 13 as it is.

In the case that the sheet correction directions of the N−1th and the Nth are not the same direction as shown in items (b) and (c) of FIG. 6, a looseness in the registration slide configuration has been already pulled. Therefore, the registration slide motor 54 is not preliminarily driven immediately after Step 5, but the slide operation is conducted using motion quantity DS computed in Step 13 as it is.

Thus, this embodiment determines the necessity of the preliminary drive in accordance with the sheet correction direction, and simultaneously, when the preliminary drive is required, the pair of registration rollers 30 are preliminarily moved by the deficiency quantity of a motion quantity, and then the lateral registration correction is conducted. In this manner, it is possible to keep the right and left space quantity of a resulting product constant without depending on the slide direction of the registration slide unit for every sheet, resulting in that the image forming apparatus capable of high-precision sheet position correction operation is provided.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-165266, filed Jul. 28, 2011, which is hereby incorporated by reference herein in its entirety.

What is claimed is:

1. An image forming apparatus having an image forming portion and a sheet conveying apparatus which corrects a skew feeding of a sheet and conveys the sheet to the image forming portion, comprising:

a skew feeding detection portion which detects a skew feeding quantity of the sheet;

a skew feeding correction portion which corrects the skew feeding of the sheet;

a side edge detection portion which detects a side edge position of the sheet in a width direction perpendicular to a sheet conveying direction after the skew feeding of the sheet has been corrected by the skew feeding correction portion;

a side edge correction portion which moves the sheet in the width direction while conveying the sheet to correct the side edge position of the sheet;

a data storage portion which stores a deficiency quantity of an inclination quantity and a deficiency quantity of a motion quantity in the width direction incurred in the side edge correction portion with respect to the sheet conveying direction at the time of moving the side edge correction portion in the width direction; and a controller which controls the skew feeding correction portion to correct the skew feeding of the sheet in accordance with the skew feeding quantity detected by the skew feeding detection portion and the deficiency quantity of the inclination quantity stored in the data storage portion, and which controls the side edge correction portion to correct a position of the side edge correction portion in the width direction in accordance with the side edge position of the sheet detected by the side edge detection portion and the deficiency of the motion quantity stored in the data storage portion.

2. The image forming apparatus according to claim 1, wherein the controller controls the side edge correction portion based on the side edge position of the sheet detected by the side edge detection portion such that, when the motion direction of the sheet is the same as the motion direction of a preceding sheet, the side edge correction portion adds the deficiency quantity of the motion quantity stored in the data storage portion and moves the sheet.

3. The image forming apparatus according to claim 1, wherein the controller sets a slide quantity, to which the deficiency quantity of the motion quantity has been added, and controls the side edge correction portion so as to move the sheet with the slide quantity.

4. The image forming apparatus according to claim 1, wherein the controller moves the side edge correction portion in the width direction by the deficiency quantity of the motion quantity before the side edge detection portion detects the side edge position of the sheet.

5. The image forming apparatus according to claim 1, wherein the side edge correction portion comprises:

a shift roller slidable in the width direction perpendicular to the sheet conveying direction;

a registration shift motor which slides the shift roller in the width direction; and a slide drive belt which converts rotation of the shift motor into slide motion of the shift roller.

6. The image forming apparatus according to claim 1, wherein the skew feeding correction portion comprises a pair of skew feeding correction rollers provided in the width direction perpendicular to the sheet conveying direction, and each driven by the skew feeding correction motor, and wherein the controller controls a conveying speed of the pair of skew feeding correction rollers based on the detection of the skew feeding detection portion.

7. The image forming apparatus according to claim 6, wherein the skew feeding detection portion comprises:

a first skew feeding detection sensor which detects a skew feeding quantity of the sheet before the skew feeding is corrected by the pair of skew feeding correction rollers; and a second skew feeding detection sensor which detects a skew feeding quantity of the sheet after the skew feeding has been corrected by the pair of skew feeding correction rollers, wherein the controller corrects the skew feeding quantity detected by the second skew detection sensor by the inclination quantity stored in the data storage portion, and controls the skew feeding correction portion by the corrected skew feeding quantity.

* * * * *